US006287159B1

(12) United States Patent
Polakowski et al.

(10) Patent No.: US 6,287,159 B1
(45) Date of Patent: Sep. 11, 2001

(54) MARINE PROPULSION DEVICE WITH A COMPLIANT ISOLATION MOUNTING SYSTEM

(75) Inventors: Stephen E. Polakowski, Houghton, MI (US); Rock J. Helsel, Campbellsport, WI (US); Tommy R. Yerby, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/694,375

(22) Filed: Oct. 23, 2000

(51) Int. Cl.[7] ..... B63H 1/15
(52) U.S. Cl. ..... 440/52; 440/111
(58) Field of Search ..... 440/52, 111, 112, 440/57

(56) References Cited

U.S. PATENT DOCUMENTS

| | | | | |
|---|---|---|---|---|
| 3,865,068 | | 2/1975 | Haasl | 115/34 |
| 4,178,873 | | 12/1979 | Bankstahl | 115/73 |
| 4,362,514 | | 12/1982 | Blanchard | 440/61 |
| 4,371,348 | | 2/1983 | Blanchard | 440/52 |
| 4,925,414 | | 5/1990 | Newman | 440/83 |
| 5,509,834 | * | 4/1996 | Rodskier | 440/57 |
| 5,944,569 | | 8/1999 | Buzzi | 440/83 |

* cited by examiner

*Primary Examiner*—Ed Swinehart
(74) *Attorney, Agent, or Firm*—William D. Lanyi

(57) ABSTRACT

A support apparatus for a marine propulsion system in a marine vessel is provided with a compliant member that is attachable to the transom of a marine vessel. In certain applications, the compliant member is directly attached to an intermediate plate and to an external frame member that is, in turn, attached directly to the transom of the marine vessel. The intermediate plate is attached directly to components of the marine propulsion system to provide support for the marine propulsion system relative to the transom, but while maintaining non-contact association between the marine propulsion system and the transom.

18 Claims, 5 Drawing Sheets

MARINE PROPULSION DEVICE WITH A COMPLIANT ISOLATION MOUNTING SYSTEM

BACKGROUND OF THE INVENTION

1. Field of the Invention

The present invention is generally related to a mounting system for a marine propulsion device and, more particularly, to a mounting system that supports the drive at the transom with a compliant component, seals the transom to prevent water leakage, and provides vibratory and noise isolation.

2. Description of the Prior Art

Many different types of marine propulsion systems are well known to those skilled in the art. Typical marine propulsion devices are sterndrive systems, outboard motors, or inboard propulsion systems. Sterndrive systems typically include an internal combustion engine that is mounted for support within a marine vessel with a crankshaft of the internal combustion engine extending toward the stern. An outdrive member is attached to the transom of the boat and extends from the transom in an aft direction. The crankshaft of the engine is connected in torque transmitting relation with a driveshaft of the outdrive member. This connection between the crankshaft and the driveshaft extends through an opening formed through the transom of the marine vessel. Marine propulsion systems of this type are well known to those skilled in the art.

U.S. Pat. No. 3,865,068, which issued to Haasl on Feb. 11, 1975, discloses a sterndrive engine mount. A three point mounting system for the engine of a marine inboard-outboard sterndrive unit is disclosed. Bi-axially adjustable side mounts support the weight of the engine and an elastomeric sealing element around the driveshaft housing is radially expanded within a cylindrical passage through the transom to steady the engine in the region immediately adjacent the U-joint.

U.S. Pat. No. 4,925,414, which issued to Newman on May 15, 1990, discloses a marine propulsion system for isolating engine sound and vibration from the boat interior. It includes an engine mounted in the aft portion of the boat by resilient mounts. The engine is enclosed within a closed compartment for isolating engine sound, with one wall of the compartment defined by the boat transom. The resilient engine mount isolate the boat from the effects of engine vibration. A drive unit is rigidly mounted to the exterior of the boat transom. A drive mechanism is provided for transferring power from the engine crankshaft to the drive unit, and includes an apparatus for accommodating engine movements and isolating the drive unit from the effect of such movements.

U.S. Pat. No. 4,178,873, which issued to Bankstahl on Dec. 18, 1979, discloses an exhaust coupling assembly for a marine sterndrive. The apparatus includes an inboard engine having an exhaust passageway connected to an outboard drive unit having an exhaust passageway. A transom bracket assembly positioned between the engine and the drive unit permits vertical pivoting of the drive unit for steering and horizontal pivoting of the drive unit for trimming. The improvement includes a first exhaust pipe connected to the inboard engine and a second exhaust pipe connected to the drive unit. The first exhaust pipe extends outward through the transom of the boat and has an open end position centered on and adjacent the vertical pivot axis and below the vertical pivot axis. The second exhaust pipe extends toward and ends in alignment with the end position of the first exhaust pipe to form an interference which includes an opening between the pipe ends.

U.S. Pat. No. 4,362,514, which issued to Blanchard on Dec. 7, 1982, describes a high performance sterndrive unit. The marine propulsion device comprises a bracket adapted to be fixed to a boat transom and having an upper portion and a lower portion, a propulsion leg including a rotatably mounted propeller, a first ball joint universally connecting the propulsion leg and the lower bracket portion, a hydraulically cylinder-piston assembly having first and second ends, a pivot connecting the first end of the hydraulic cylinder-piston assembly to the propulsion leg about an axis which is generally horizontal when the bracket is boat mounted, a second ball joint universally connecting the second end of the hydraulic cylinder-piston assembly to the upper bracket portion, and a drive train adapted to be connected to a prime mover, extending through the bracket and the propulsion leg and drivingly connected to the propeller.

U.S. Pat. No. 4,371,348, which issued to Blanchard on Feb. 1, 1983, describes a mounting for a marine propulsion device located aft of a boat transom. It comprises a bracket adapted to be fixed relative to the transom of a boat and includes an opening extending generally horizontally when the bracket is boat mounted, a marine propulsion unit including a fixed assembly extending through the opening, fixed relative to the bracket, and including a power head located above the bracket and including an internal combustion engine. It also comprises an upper housing located below the bracket and fixed to the power head. The propulsion unit also includes a lower housing connected to the upper housing for pivotal movement therebetween about a tilt axis which is horizontal when the bracket is boat mounted, a gear case assembly connected to the lower housing for pivotal movement therebetween about a steering axis which is transverse to the tilt axis, a propeller rotatably carried by the gear case assembly, and a drive train connected to the propeller and the engine and extending through the gear case assembly and the lower and upper housings.

U.S. Pat. No. 5,944,569, which issued to Buzzi on Aug. 31, 1999, describes a simplified propelling system with drive integral to each other. The system supports a propeller shaft of adjustable inclination where the front end of the propeller-supporting shaft is carried by a hollow cylindrical body steadily fixed to the reversing gear box, which in turn is steadily fixed to the engine. The hollow cylindrical body comes out of the stem surface of the boat through a hole sealed by rubber rings which allow small angle adjustments to modify the inclination of the propeller-supporting shaft, further carried by an adjustable support placed outside the boat. The inclination of the propeller-supporting shaft is modified by raising or lowering a single assembly including the engine, the reversing gear box, the hollow cylindrical body and the propeller-supporting shaft.

The patents described above are hereby expressly incorporated by reference in the description of the present invention.

Marine propulsion systems known to those skilled in the art are rigidly mounted to the transom of a marine vessel for at least one point of support. In a typical situation, where a sterndrive marine propulsion system is used, the system is supported by two or more engine supports that are attached to the engine and to the marine vessel to supply support for the engine. A third point of support is generally provided at the transom where the drive train of the sterndrive system passes through a hole in the transom. Usually, the engine is mounted to the inner surface of the transom with tube-like rubber isolators and an outdrive housing is rigidly mounted to an outer surface of the transom. These attachments of the engine and the outdrive to the transom provides support for both major members of the marine propulsion system and also provide sealing to prevent water from leaking through the transom proximate the hole formed to accommodate the torque transmitting shafts.

It would be significant beneficial if a means could be provided to adequately support the marine propulsion system while also isolating the propulsion system from the transom. This isolation would significantly reduce the transmission of vibration and noise, emanating from the engine and outdrive unit, to the boat.

SUMMARY OF THE INVENTION

A marine propulsion system made in accordance with a preferred embodiment of the present invention comprises a compliant member which serves as one of the main support devices, at the transom of a marine vessel, for the marine propulsion system. The compliant member is attachable to a transom of the marine vessel. It is shaped to provide support for a drive housing of the marine propulsion system and is located between the drive housing and the transom, with the transom between the gimbal housing and the flywheel housing. The compliant member prevents direct contact between the drive housing and the transom of the marine vessel. The compliant member is shaped to receive a driveshaft extending through the transom and through a central opening of the compliant member, wherein the driveshaft extends between an engine and the marine propulsion system. It should be understood that, in its basic structure, the marine propulsion system support apparatus of the present invention does not require the engine, the drive housing, or the driveshaft that can extend through the opening of a compliant member.

In a preferred embodiment of the present invention, the compliant member is generally co-planar with the transom of the marine vessel. This terminology is used herein to describe the characteristic of the compliant member which allows it to be placed within a hole formed in the transom of the marine vessel and not extend significantly, in a forward or aft direction, from the fore and aft surfaces of the transom itself. Although both the transom of the marine vessel and the compliant member have thickness that is greater than that normally described by the term "co-planer", that term is used in the description of the present invention to describe the fact that the compliant member is able to be located within a hole formed through the transom and between the fore and aft surfaces of the transom in a typical application. However, it should be understood that the thickness of the compliant member, in the fore and aft directions, is not a limiting factor of the present invention.

In a particularly preferred embodiment of the present invention, an intermediate plate is attachable to the engine and to the drive housing. The intermediate plate is a rigid structure that is attached between the engine, compliant member, and gimbal housing. The intermediate plate is attached to the compliant member for support by the compliant member. The compliant member is shaped to provide support for the drive housing through the intermediate plate when the compliant member is attached to the transom. In certain embodiments of the present invention, a frame member is rigidly attached to the transom and the compliant member is attached to the frame member for support by the transom. In this type of application, the compliant member is supported in noncontact association with the transom by its attachment to the frame member which, in turn, is attached directly to the transom.

In certain applications of the present invention, the support apparatus for the marine vessel further comprises an engine which is attached to the compliant member and a drive housing that is attached to the compliant member. When an intermediate plate is provided, the engine is attached directly to the intermediate plate and the drive housing is attached directly to the intermediate plate. As described above, it should be understood that the engine is located forward of the compliant member and the drive housing is located aft of the compliant member.

The present invention, when attached to an engine and a drive housing, further comprises a first shaft of the engine that extends from the engine in a direction toward the drive housing. This first shaft is typically an extension of the crankshaft of the engine. The apparatus further comprises a second shaft that extends from the drive housing in a direction toward the engine. In a typical application, the second shaft is a driveshaft of the drive housing. The first and second shafts are coupled together in torque transmitting relation through an opening of the compliant member. This coupling arrangement can comprise a universal joint. The drive housing can house both a driveshaft and a propeller shaft which are both disposed for support within the drive housing. The drive and propeller shaft are connected together in torque transmitting relation with each other. The engine is supported within the marine vessel. Usually, there are also two mounts on the sides of the engine, near the front, to further support the unit. These two mounts are retained in applications of the present invention.

A marine propulsion apparatus for a marine vessel, made in accordance with the preferred embodiment of the present invention, comprises an engine disposed within the marine vessel and on a first side of a transom of the marine vessel. It also comprises a drive housing disposed externally to the marine vessel and on a second side of the transom of the marine vessel. In addition, it comprises a compliant member attached to the transom of the marine vessel, either directly or indirectly, and providing support for the drive housing between the drive housing and the transom. An intermediate plate is attached to the engine and to the drive housing. The intermediate plate is attached to the compliant member and provides support for the drive housing through the intermediate plate and through the compliant member. A first shaft of the engine extends from the engine in a direction toward the drive housing and a second shaft extends from the drive housing in a direction toward the engine. The first and second shafts are coupled together in torque transmitting relation through an opening of the compliant member. A frame member is rigidly attached to the transom and the compliant member is attached for support to the frame member. This connection between the compliant member and the frame member provides support for the compliant member by the transom. The compliant member is supported in noncontact association with the transom.

In all embodiments of the present invention, it should be understood that the compliant member provides vibration and noise isolation between the marine propulsion system and the marine vessel. Although known marine propulsion systems have provided elastomeric components to seal moisture from passing through an opening in the transom, those known elastomeric devices are typically rigidly compressed between associated components and, therefore, do not isolate vibrations from being transmitted through their structure. The present invention, on the other hand, is compliant in the sense that vibrations are damped and inhibited from passing through the structure of the compliant member. It also seals the transom and supports the unit in conjunction with other conventional support devices.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
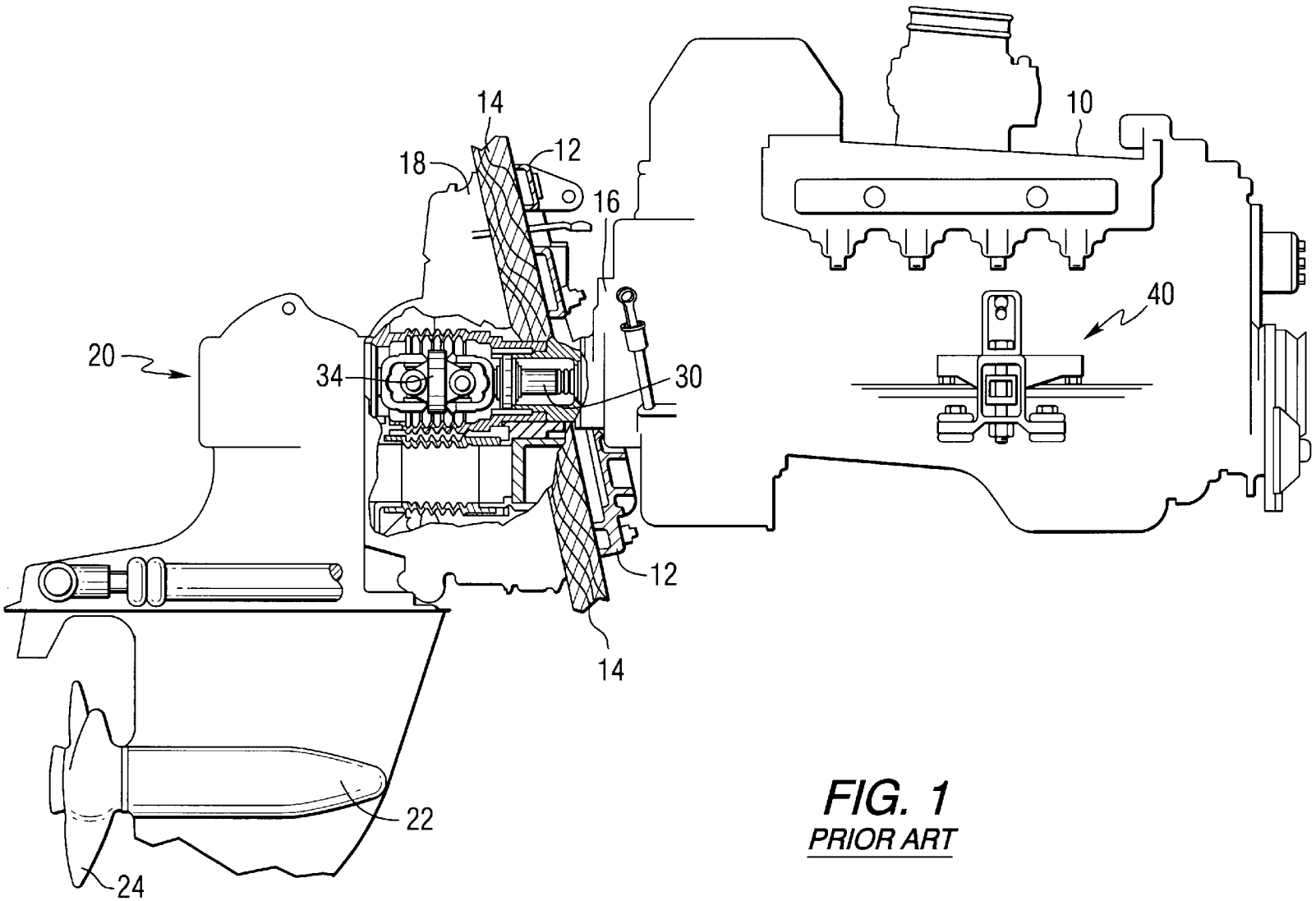
FIG. 1 PRIOR ART
FIG. 1 shows a prior art arrangement of a marine propulsion system in relation to a transom of a marine vessel.

Throughout the description of the preferred embodiment of the present invention, like components will be identified by like reference numerals.

FIG. 1 is a side view of a marine propulsion system similar to that illustrated in FIG. 1 of U.S. Pat. No. 3,865,068, described above. FIG. 1 represents a known configuration of a marine propulsion system in which an engine 10 is provided with a transom plate 12 that attaches to a portion of the engine 10 which is referred to as an "engine transmission cover" in U.S. Pat. No. 3,865,068 and identified by reference numeral 16 in FIG. 1. The drive housing 18 is shown rigidly attached to the transom 14. The sterndrive unit 20 is supported by the drive housing 18. Although not shown in FIG. 1, the sterndrive unit 20 comprises a vertical driveshaft and a horizontal propeller shaft disposed within a propeller housing 22. The propeller 24 is attached for rotation with the propeller shaft.

With continued reference to FIG. 1, the crankshaft 30 of the engine 10 is connected in torque transmitting relation with the vertical driveshaft of the sterndrive unit 20. Torque is transmitted through a universal joint 34. As can be seen in FIG. 1, the torque transmitting shafts, including the crankshaft 30, extend through a hole formed in the transom 14.

The marine propulsion system illustrated in FIG. 1 is supported by a three point support system. Reference numeral 40 identifies a side engine mount that is disposed on the starboard side of the engine. A similarly configured side engine mount is also disposed on the port side of the engine 10 to provide two points of support for the engine 10. A third point of support is provided by the attachment of both the transom plate 12 and the drive housing 18 to the transom 14. There are mounts located at the back portion of the engine, between the transom and the engine, but the engine and drive unit are not structurally connected directly to each other. Although the torque transmitting shafts are free to rotate and are not in direct physical contact with the transom 14, it should be clearly understood that the transom plate 12 and the drive housing 18 shown in FIG. 1 are both rigidly attached to the transom 14 and provide a third point of support for the marine propulsion system. It is important to note that the present invention physically connects the drive unit to the engine. This connection eliminates possible misalignment of the two torque transmitting shafts and facilitates assembly procedures. The other components shown in FIG. 1 will not be described in detail herein because of the full and complete disclosure of this type of marine propulsion system in U.S. Pat. No. 3,865,068.

With marine propulsion systems such as that described above in conjunction with FIG. 1, vibrations primarily emanating from the engine 10 and drive unit, the torque transmitting shafts, and the propeller 24 are transmitted directly into the transom 14 because of the rigid connection between the transom 14 and both the drive housing 18 and the transom plate 12. These vibrations are then transmitted directly to the marine vessel of which the transom 14 is an integral part. Increased vibration not only results in noise, but also adversely affects the pleasure of operating the marine vessel.

Figure 2:
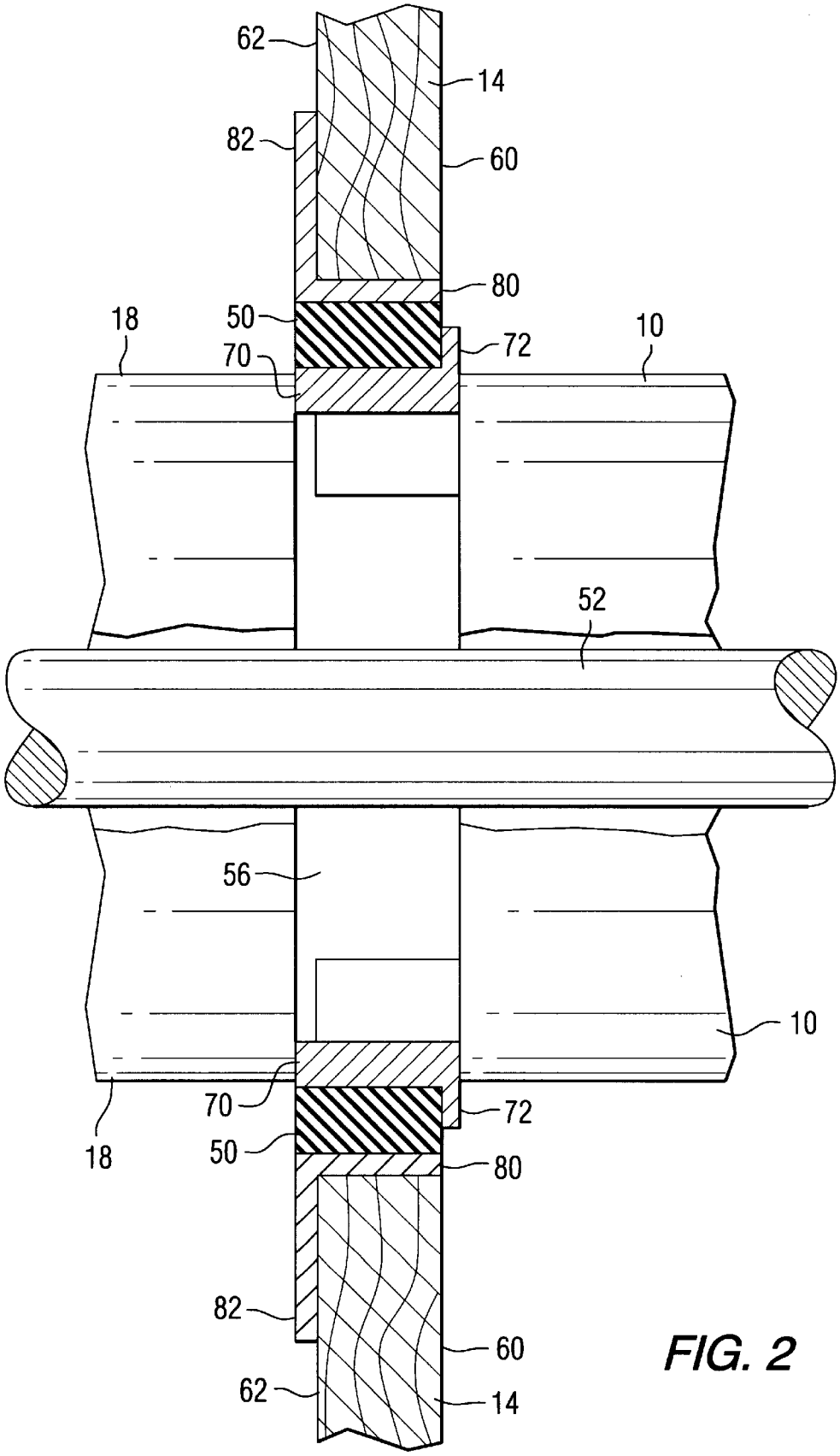
FIG. 2 is a highly simplified schematic representation of the present invention.

FIG. 2 is a highly schematic illustration of the present invention, with the engine 10 on the fore side of the transom 14 and the drive housing 18 on the aft side of the transom 14, and is provided as a means for identifying certain important components of the present invention. These components will be shown in their more preferred shapes and configurations below, but the simplified representation of FIG. 2 allows each component to be described in terms of its physical location in relation to the other components. A compliant member 50, which can be made of an elastomeric material such as rubber or other types of elastomeric materials, is attachable to a transom 14 of a marine vessel. The compliant member 50 is shaped to provide support for a drive housing 18 such as that described above in conjunction with FIG. 1. The compliant member 50 is disposed generally between the drive housing 50 and the transom 14. In this context, the term "between" means that the compliant member 50 prevents direct contact between the drive housing 18 and the transom 14. The compliant member 50 is shaped to receive a driveshaft, such as that schematically represented in FIG. 2 and identified by reference numeral 52, which extends through the transom 14 and through a central opening 56 of the compliant member. The shaft is not actually supported by the compliant member but, instead, passes through it. The central opening 56 through which the driveshaft 52 extends is between the engine 10 and the marine propulsion system which comprises the drive housing 18. This central opening 56 also allows electric cables, exhaust gasses, hydraulic lines, water cooling lines, and shifting components to extend through the transom. The compliant member 50 is generally co-planar with the transom 14. Although the compliant member 50 and the transom 14 both have thickness, as shown in FIG. 2, the term "co-planar" in this context is used to mean that most or all of the thickness of the compliant member 50 is located within the thickness of the transom 14 between a first side 60 of the transom 14 which faces forward relative to the marine vessel and a second side 62 of the transom 14 which faces aft. It can be seen that the compliant member attaches to the outside of the transom and therefore allows transoms of different thicknesses to be accommodated.

With continued reference to FIG. 2, an intermediate plate 70 is attachable to the engine 10 and to the drive housing 18 as shown. The intermediate plate 70 is attached to the compliant member 50 for support by the compliant member. The compliant member is shaped to provide support for the drive housing 18 through the intermediate plate 70 when the compliant member is attached for support to the transom 14. When the intermediate plate 70 is used as part of the present invention, the engine 10 and the drive housing 18 are both attached directly to the intermediate plate 70. Alternative configurations of the present invention could attach the engine 10 and the drive housing 18 to each other through the compliant member 50 without the need for the intermediate plate 70. However, a preferred embodiment of the present invention incorporates the intermediate plate 70, or intermediate structure, as part of the integral structure with the compliant member 50.

The present invention also comprises a frame member 80 that can be rigidly attached to the transom 14. The compliant member 50 is attached to the frame member 80 for support by the transom 14. The compliant member 50 is in non-contact association with the transom 14 when the frame member 80 is used. In a particularly preferred embodiment of the present invention, the frame member 80, the intermediate plate 70, and the compliant member 50 are formed as part of an integral structure. Both the frame member 80 and the intermediate plate 70 are preferably made of conventional steel, aluminum, or stainless steel and the compliant member 50 is preferably made of an elastomeric material, such as rubber or other elastomeric materials.

With continued reference to FIG. 2, it can be seen that the frame member 80 is provided with an external flange 82 which is attachable to the outer or second 62 surface of the transom 14. This allows the frame member 80 to be bolted rigidly to the transom 14. FIG. 2 also shows the intermediate plate 70 as having an inner flange 72 as will be described in greater detail below, flanges formed on both the intermediate plate 70 and the frame member 80 are provided to assist in reacting to forces generated when the marine propulsion system generates thrust to cause movement of the marine vessel.

Figure 3:
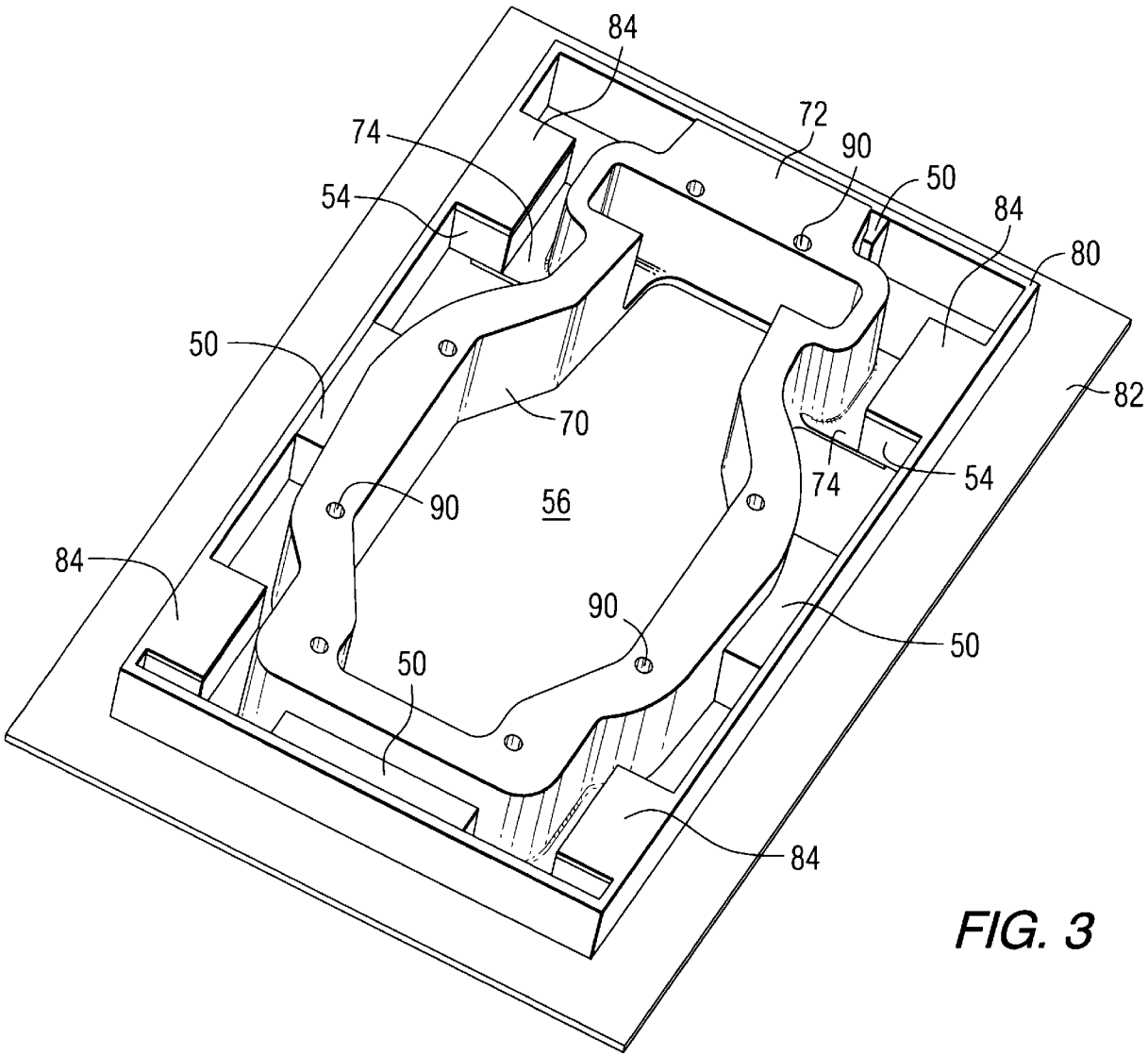
FIG. 3 is a view of the present invention taken in a direction from a marine vessel.

FIG. 3 is an isometric view of the present invention as seen from the direction facing aft from within the marine vessel. The frame member 80 is shown with its outer flange 82 that can be rigidly attached to the outer surface of the transom 14, as described above in conjunction with FIG. 2. The central opening 56 is shown within the structure of the intermediate plate 70 which is shown with its internal flange 72. It should be noted that the intermediate member 70 in FIG. 3 is not provided with a symmetrically located flange 72 at its opposite end. The compliant member 50 is shown disposed around the periphery of the intermediate plate 70 and within the structure of the frame member 80.

With continued reference to FIG. 3, several inwardly extending plates 84 are shown attached to the frame member 80. Also, several outwardly extending plates 74 are shown extending from the intermediate plate 70. Each of the inwardly directed plates 84 are associated with an outwardly directed plate 74 as shown. Four of these combinations are illustrated clearly in FIG. 3. For each associated pair of plates, a portion 54 of the compliant member 50 is located between surfaces of the two plates, 74 and 84. These arrangements provide support for the present invention which reacts to thrust forces in either the forward or aft direction.

In FIG. 3, a plurality of holes 90 are provided to facilitate attachment of the drive unit to the intermediate plate 70, as described above.

Figure 4:
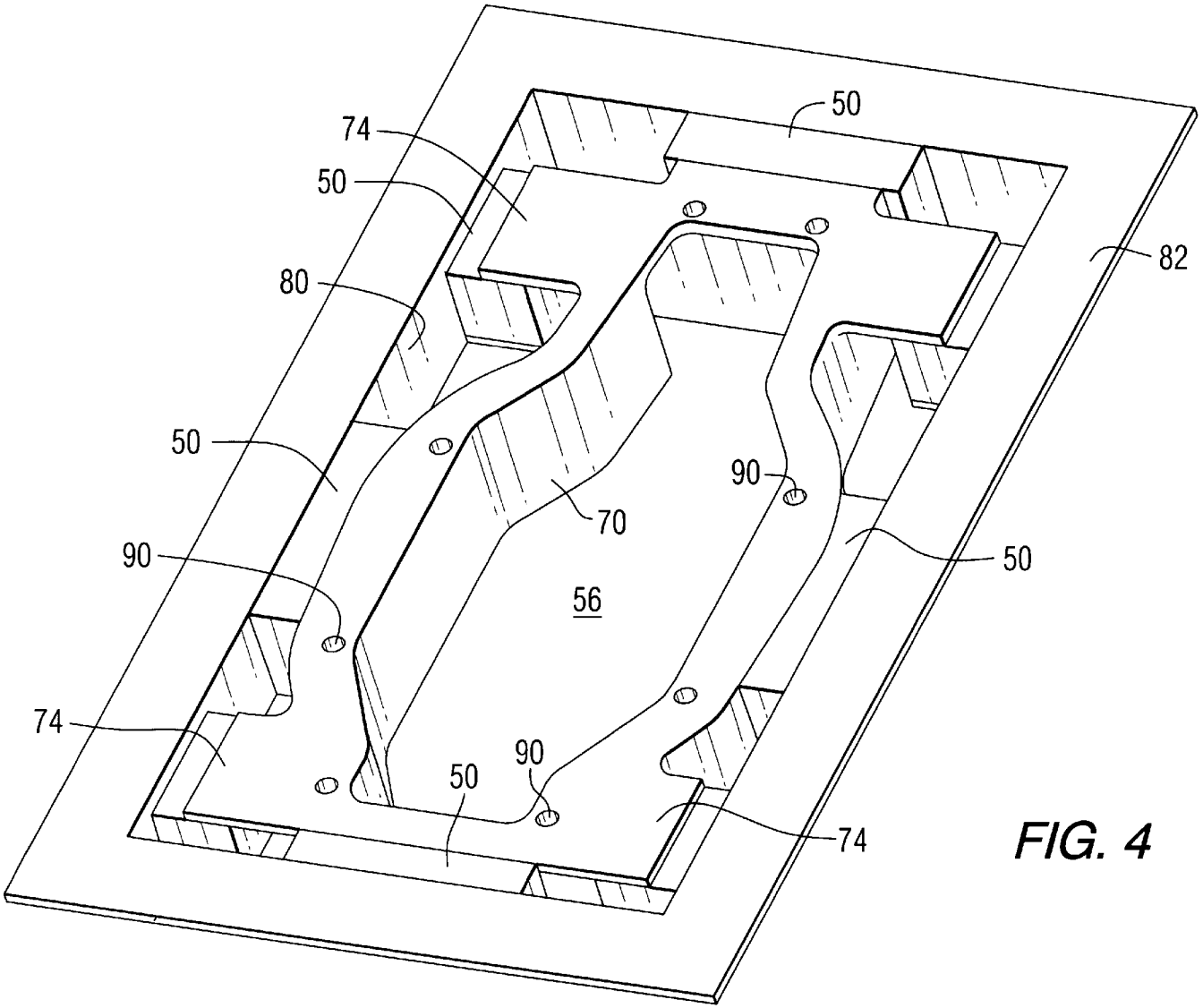
FIG. 4 is a view of the present invention taken in a direction from aft of a marine vessel.

FIG. 4 is a isometric illustration of the present invention as viewed from a position aft of a marine vessel. The outer flange 82 of the frame member 80 is shown surrounding the compliant member 50 and the intermediate plate 70. The outwardly extending plates 74 are shown as integral portions of the intermediate plate 70. By comparing FIGS. 3 and 4, the relative locations of the outwardly extending plates 74 and inwardly extending plates 84 can be more clearly understood. The central opening 56 is located within the structure of the intermediate plate 70 and the holes 90 are shown extending through the thickness of the intermediate plate 70.

With reference to FIGS. 3 and 4, several characteristics of the present invention can be seen. The frame member 80 is not in direct physical contact with the intermediate plate 70. Although the frame member 80 provides support for the intermediate plate 70 and the marine propulsion system that can be attached to the intermediate plate 70, that support is provided through the compliant member 50. The intermediate plate and the compliant member can be bonded directly together. This allows the compliant member 50 to isolate the intermediate plate 70 from the frame member 80 and, as a beneficial result of this isolation, vibrations emanating from the engine 10 or the sterndrive unit will not be transmitted to the frame member 80 and the transom 14 of the boat to which it is attached.

Throughout the description of the preferred embodiment, in conjunction with FIGS. 2–4, the advantage of vibration isolation has been discussed in detail. However, another significant advantage provided by the present invention is the ease of assembly and alignment that it provides. Because both the drive and the engine are rigidly attached to the intermediate plate 70, alignment of the system is simplified. In the past, the engine was mounted on flexible mounts and alignment of these components to assure a proper alignment of the torque transmitting shafts was a much more complex and time consuming procedure. However, since both the engine 10 and the drive housing 18 can be easily attached to the intermediate plate 70, and the intermediate plate 70 is supported by the compliant member 50, the alignment procedure is significantly simplified. Any minor misalignments of the various components inside and outside of the marine vessel can easily be accommodated by the compliant nature of the compliant member 50. In systems known to those skilled in the art, the height and lateral location of the mounts were critical elements for proper alignment of the torque shafts. Now, with the present invention, this tolerance requirement can be significantly relaxed.

Figure 5:
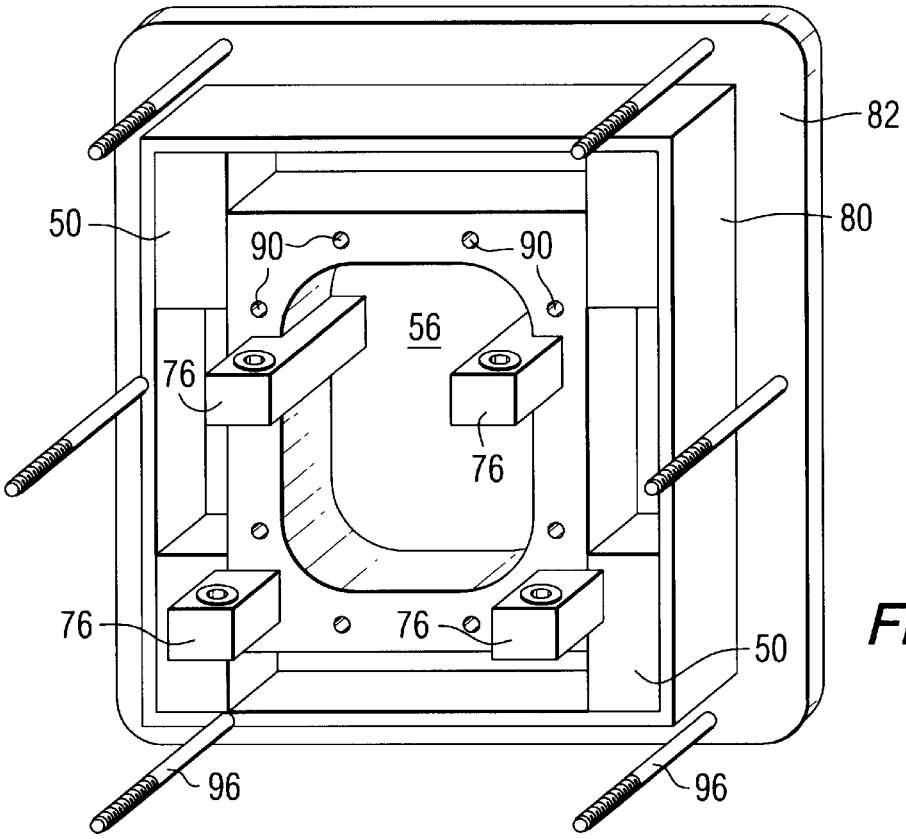
FIG. 5 is an isometric view of an alternative embodiment of the present invention.

In the description of the preferred embodiment relating to FIGS. 2–4, the engine 10 and the drive housing 18 are described as being attached to the intermediate plate 70 with bolts extending through holes 90. However, it should be understood that other, sometimes preferable, means for attaching the engine 10 and drive housing 18 to the intermediate plate 70 are also possible within the scope of the present invention. For example, FIG. 5 shows an alternative configuration of the intermediate plate 70 which is provided with a plurality of pads 76 which, in turn, are provided with vertically extending holes through their thicknesses. These pads 76 can be used to support the engine 10. In FIG. 5, the frame member 80 is shown with its outer flange 82 and the compliant member 50 is shown between the intermediate plate 70 and the frame member 80, as described above. A plurality of bolts 96 are shown extending through the outer flange 82 of the frame member 80. These bolts 96 would extend through the transom 14 of a boat to facilitate the direct rigid attachment of the frame member 80 to the transom 14.

Figure 6:
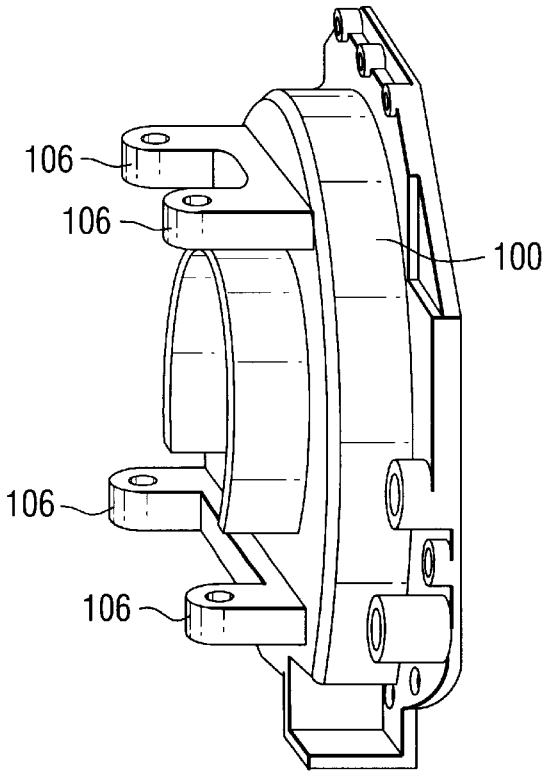
FIG. 6 shows a portion of an engine that is adapted to be used with the embodiment illustrated in FIG. 5.

FIG. 6 shows a bell housing 100 which is attachable as part of an engine configuration. The bell housing is provided with a plurality of pads 106 extending from the bell housing in an aft direction. The four pads 106 of the bell housing 100 are located and spaced apart from each other to be associated with the four pads 76 of the intermediate plate 70 shown in FIG. 5. This arrangement allows the bell housing 100 to be rigidly attached to the intermediate plate 70 by aligning the vertical extending holes in pads 76 and 106 and bolting the bell housing 100 rigidly to the intermediate plate 70. It should also be noted that the two lower pads are spaced farther apart than the two upper pads. This allows the engine to be lowered directly downward for ease of installation.

This wider spacing of the lower two pads 76 avoids interference with the movement of the engine in a downward direction during assembly of the system in a marine vessel and also facilitates the operation of bolting the system into place.

In the embodiments of the present invention described above, a compliant member 50 is attachable to a transom 14 of a marine vessel, with the compliant member 50 being shaped to provide support for a drive housing 18 of a marine propulsion system between the drive housing 18 and the transom 14. This arrangement prevents direct contact between the drive housing 18 and the transom 14 of the marine vessel. The compliant member 50 is shaped to receive a driveshaft 52 extending through the transom 14 and through a central opening 56 of the compliant member 50, wherein the central opening 56 is located between an engine 10 and the drive housing 18. In a preferred embodiment of the present invention, the compliant member 50 is generally co-planar with the transom 14 and an intermediate plate 70 is attachable to the engine 10 and to the drive housing 18. The intermediate plate 70 is attached to the compliant member 50 for support by the compliant member 50 and the compliant member 50 is shaped to provide support for the drive housing 18 through the intermediate plate 70 when the compliant member 50 is attached to the transom 14. A frame member 80 is rigidly attached to the transom 14 and the compliant member 50 is attached to the frame member 80 for support by the transom 14. The compliant member 50 is supported in non-contact association with the transom 14.

In all embodiments of the present invention, a compliant member 50 is used to isolate the vibrations of the engine and the drive housing 18 from direct physical contact with the transom 14. Whether or not the compliant member 50 is associated with an intermediate plate 70 and a frame member 80, it serves to allow relative movement between the marine propulsion system and the transom 14. Not only does the present invention provide the significant advantage of isolating vibrations in this way, but it also provides an equally significant benefit in facilitating the alignment of the engine 10 and the drive housing 18 during assembly of the marine propulsion system in a boat. Since the compliant member 50 allows relative movement between the marine propulsion system and the transom 14, alignment is significantly easier than if both the engine 10 and the drive housing 18 are rigidly attached directly to the transom 14. It is recognized that certain prior art marine propulsion systems may have used thin elastomeric seals to provide water tight sealing between the transom 14 and components attached to the transom 14, but those elastomeric seals do not allow relative movement between the marine propulsion system and the transom 14. The present invention provides a compliant member 50 that allows relative movement between the transom 14 and the components of the marine propulsion system. Not illustrated in the Figures, but possibly applicable in conjunction with the present invention is a cover plate that can be attachable to the outer flange 82 and extending radially inward to cover the compliant member 50 and protect it from abrasion and other possible damage.

Although the present invention has been described with particular detail and two embodiments illustrated specifically, it should be understood that alternative embodiments are also within its scope.

I claim:

1. A marine propulsion system support apparatus for a marine vessel, comprising:

a compliant member attachable to a transom of said marine vessel, said compliant member being shaped to provide support for a drive housing of said marine propulsion system between said drive housing and said transom and to prevent direct contact between said drive housing and said transom of said marine vessel, said compliant member being shaped to receive a drive shaft extending through said transom and through a central opening of said compliant member between an engine and said drive housing; and an intermediate plate removably attachable to said engine and removably attachable to said drive housing for support of said engine and said drive housing by said compliant member, said engine also being supported by individual supports within said marine vessel, said intermediate plate being attached to said compliant member for support by said compliant member, said compliant member being shaped to provide support for said drive housing through said intermediate plate when said compliant member is attached to said transom, said intermediate plate being generally coplanar with said transom and disposed within an opening formed in said transom.

2. The apparatus of claim 1, wherein:

said compliant member is generally coplanar with said transom of said marine vessel.

3. The apparatus of claim 1, further comprising:

said engine attached to said intermediate plate; and said drive housing attached to said intermediate plate.

4. The apparatus of claim 3, wherein:

a first shaft of said engine extending from said engine in a direction toward said drive housing; and a second shaft extending from said drive housing in a direction toward said engine, said first and second shafts being coupled together in torque transmitting relation through an opening of said intermediate plate.

5. The apparatus of claim 4, further comprising:

a drive shaft disposed for support within said drive housing and connected in torque transmitting relation with said second shaft.

6. The apparatus of claim 5, further comprising:

a propeller shaft disposed for support within said drive housing and connected in torque transmitting relation with said drive shaft.

7. The apparatus of claim 1, further comprising:

a first plurality of pads extending from said intermediate plate in a direction toward said engine; and a second plurality of pads extending from said engine in a direction toward said intermediate plate, said first and second plurality of pads being attachable to each other to attach said engine to said intermediate plate.

8. The apparatus of claim 1, further comprising:

a frame member attachable to said transom and to said compliant member to support said compliant member;

a first plurality of plates extending from an outer periphery of said intermediate plate in a direction toward said frame member;

a second plurality of plates extending from an inner periphery of said frame member in a direction toward said intermediate plate, said first and second pluralities of plates being generally parallel to said transom, selected portions of said compliant member being disposed between associated ones of said first and second pluralities of plates.

9. A marine propulsion apparatus for a marine vessel, comprising:

an engine disposed and supported within said marine vessel and on a first side of a transom of said marine vessel;

a drive housing, disposed externally to said marine vessel and on a second side of said transom of said marine vessel;

a compliant member attached to said transom of said marine vessel, said compliant member providing support for said drive housing between said drive housing and said transom;

an intermediate plate removably attached to said engine and to said drive housing, said intermediate plate being attached to said compliant member, said compliant member providing support for said drive housing and said engine through said intermediate plate, said intermediate plate and said compliant member being generally coplanar with said transom; and a frame member rigidly attached to said transom, said compliant member being attached to said frame member for support by said transom, said compliant member being in noncontact association with said transom.

10. The apparatus of claim 1, wherein:

a first shaft of said engine extending from said engine in a direction toward said drive housing; and a second shaft extending from said drive housing in a direction toward said engine, said first and second shafts being coupled together in torque transmitting relation through an opening of said intermediate plate.

11. The apparatus of claim 3, further comprising:

a drive shaft disposed for support within said drive housing and connected in torque transmitting relation with said second shaft.

12. The apparatus of claim 9, further comprising:

a first plurality of pads extending from said intermediate plate in a direction toward said engine; and a second plurality of pads extending from said engine in a direction toward said intermediate plate, said first and second plurality of pads being attachable to each other to attach said engine to said intermediate plate.

13. The apparatus of claim 9, further comprising:

a frame member attachable to said transom and to said compliant member to support said compliant member;

a first plurality of plates extending from an outer periphery of said intermediate plate in a direction toward said frame member;

a second plurality of plates extending from an inner periphery of said frame member in a direction toward said intermediate plate, said first and second pluralities of plates being generally parallel to said transom, selected portions of said compliant member being disposed between associated ones of said first and second pluralities of plates.

14. A marine propulsion apparatus for a marine vessel, comprising:

an engine disposed and supported within said marine vessel and on a first side of a transom of said marine vessel;

a drive housing, disposed externally to said marine vessel and on a second side of said transom of said marine vessel;

a compliant member attached to said transom of said marine vessel, said compliant member providing support for said drive housing between said drive housing and said transom;

an intermediate plate attached to said engine and to said drive housing, said intermediate plate being attached to said compliant member, said compliant member providing support for said drive housing through said intermediate plate, said intermediate plate and said compliant member being generally coplanar with said transom; and a frame member rigidly attached to said transom, said compliant member being attached to said frame member for support by said transom, said compliant member being in noncontact association with said transom.

15. The apparatus of claim 14, wherein:

a first shaft of said engine extending from said engine in a direction toward said drive housing; and a second shaft extending from said drive housing in a direction toward said engine, said first and second shafts being coupled together in torque transmitting relation through an opening of said intermediate plate.

16. The apparatus of claim 15, further comprising:

a drive shaft disposed for support within said drive housing and connected in torque transmitting relation with said second shaft.

17. The apparatus of claim 14, further comprising:

a first plurality of pads extending from said intermediate plate in a direction toward said engine; and a second plurality of pads extending from said engine in a direction toward said intermediate plate, said first and second plurality of pads being attachable to each other to attach said engine to said intermediate plate.

18. The apparatus of claim 14, further comprising:

a frame member attachable to said transom and to said compliant member to support said compliant member;

a first plurality of plates extending from an outer periphery of said intermediate plate in a direction toward said frame member;

a second plurality of plates extending from an inner periphery of said frame member in a direction toward said intermediate plate, said first and second pluralities of plates being generally parallel to said transom, selected portions of said compliant member being disposed between associated ones of said first and second pluralities of plates.

* * * * *